US009155413B2

(12) United States Patent
Mainetti

(10) Patent No.: US 9,155,413 B2
(45) Date of Patent: Oct. 13, 2015

(54) SIZER FOR A HANGER, A COMBINATION THEREOF, AND A METHOD OF USE

(71) Applicant: MAINETTI S.P.A., Castelgomberto (Vicenza) (IT)

(72) Inventor: Mario Mainetti, Valdagno VI (IT)

(73) Assignee: MAINETTI S.P.A., Castelgomberto (Vicenza) (IT)

( * ) Notice: Subject to any disclaimer, the term of this patent is extended or adjusted under 35 U.S.C. 154(b) by 0 days.

(21) Appl. No.: 14/281,151

(22) Filed: May 19, 2014

(65) Prior Publication Data

US 2014/0250663 A1 Sep. 11, 2014

Related U.S. Application Data

(63) Continuation of application No. 13/444,066, filed on Apr. 11, 2012, now Pat. No. 8,833,618.

(51) Int. Cl.
*A41D 27/22* (2006.01)
*A47G 25/14* (2006.01)

(52) U.S. Cl.
CPC ..... *A47G 25/1407* (2013.01); *A47G 25/1428* (2013.01); *A47G 25/1435* (2013.01); *Y10T 29/49826* (2015.01)

(58) Field of Classification Search
CPC ..... A47G 25/1407; A47G 25/1414; A47G 25/1421; A47G 25/1428; A47G 25/1435; G09F 3/04
See application file for complete search history.

(56) References Cited

U.S. PATENT DOCUMENTS

| | | | | |
|---|---|---|---|---|
| 4,198,773 | A | 4/1980 | Batts et al. | |
| 5,096,101 | A * | 3/1992 | Norman et al. | 223/85 |
| 5,441,182 | A | 8/1995 | Sullivan | |
| 5,469,995 | A * | 11/1995 | Bredeweg et al. | 223/85 |
| 5,524,801 | A * | 6/1996 | Dooley et al. | 223/85 |
| 5,642,840 | A * | 7/1997 | Abdi | 223/85 |
| 6,019,260 | A * | 2/2000 | Gouldson | 223/85 |
| 6,145,713 | A | 11/2000 | Zuckerman | |
| D510,198 | S | 10/2005 | Willardson | |
| D528,807 | S | 9/2006 | Mainetti | |
| 7,240,813 | B1 | 7/2007 | Goldman | |
| 7,287,674 | B1 | 10/2007 | Sutton et al. | |
| 7,303,101 | B2 | 12/2007 | Goldman | |

(Continued)

FOREIGN PATENT DOCUMENTS

AU 49049 85 5/1986

OTHER PUBLICATIONS

European Search Report dated Apr. 29, 2010, from the corresponding European Application.

(Continued)

*Primary Examiner* — Nathan Durham
(74) *Attorney, Agent, or Firm* — Katten Muchin Rosenman LLP

(57) ABSTRACT

A sizer for a hanger lacking a hook boss includes a pair of longitudinal walls spaced apart from each other by a pair of end sections. The sizer may include a pair of protrusion, wherein a first is disposed on a first wall of the pair of longitudinal walls and directed toward a second wall of the pair of longitudinal walls. A first jaw is disposed on one of the pair of end section. The pair of longitudinal walls flexes apart when the jaw passes over a flange of the hanger. The first jaw includes a lower portion having a curved edge. The first jaw further includes an upper portion. The lower portion and upper portion meet at an abrupt jaw point.

13 Claims, 7 Drawing Sheets

(56) References Cited

U.S. PATENT DOCUMENTS

| | | | | |
|---|---|---|---|---|
| 7,513,400 | B2 | 4/2009 | Gouldson | |
| 7,516,875 | B2 * | 4/2009 | Gouldson | 223/85 |
| 7,628,301 | B2 | 12/2009 | Goldman et al. | |
| 7,905,376 | B2 | 3/2011 | Gouldson | |
| 2003/0019137 | A1 * | 1/2003 | Giustini et al. | 40/322 |
| 2006/0006204 | A1 * | 1/2006 | Mainetti | 223/85 |
| 2006/0213938 | A1 | 9/2006 | Gouldson | |
| 2007/0062984 | A1 | 3/2007 | Louw | |
| 2007/0084889 | A1 | 4/2007 | Fleming | |
| 2007/0199963 | A1 * | 8/2007 | Gouldson | 223/85 |
| 2008/0054029 | A1 | 3/2008 | Ho | |
| 2009/0120973 | A1 | 5/2009 | Ho | |
| 2009/0294492 | A1 | 12/2009 | Goldman et al. | |
| 2010/0019002 | A1 | 1/2010 | Gouldson | |
| 2010/0237109 | A1 | 9/2010 | Gouldson | |
| 2010/0270338 | A1 | 10/2010 | Mainetti | |

OTHER PUBLICATIONS

European Written Opinion dated Apr. 27, 2009, from the corresponding European Application.

U.S. Office Action dated Jul. 19, 2013 from corresponding U.S. Appl. No. 13/444,066.

U.S. Office Action dated Mar. 12, 2014 from corresponding U.S. Appl. No. 13/444,066.

U.S. Office Action dated Jul. 31, 2015 from corresponding application No. 14/745,872.

* cited by examiner

SIZER FOR A HANGER, A COMBINATION THEREOF, AND A METHOD OF USE

CROSS-REFERENCE TO RELATED APPLICATIONS

This application is a continuation of and claims priority from U.S. Ser. No. 13/444,066, filed Apr. 11, 2012, which is pending and which is hereby incorporated by reference in its entirety for all purposes.

BACKGROUND OF THE INVENTION

1. Field of the Invention

The invention relates to a sizer for garment hangers, a combination thereof and a method of use. Specifically, the invention relates to a sizer that is removable from a first hanger and re-usable on the first hanger or on a second hanger.

2. Description of the Related Art

Garment hangers ("hangers") used in retail stores comprise a body on which an article of clothing is supported, a hook portion that suspends the hanger from a support, such as a rod, and a neck that joins the hook to the body. Hangers are provided with an indicator ("sizer") that provides suitable sizing information, i.e., small, medium, etc, about the clothing that is supported on the hanger.

One type of hanger is a garment-on-hanger hanger ("GOH hanger"). GOH hangers may have an integral body and hook, which is cost effectively manufactured by plastic injection molding. GOH hangers may also comprise a rotatable metal hook that is embedded in a plastic body.

Regardless of how it is made, most GOH hangers are notable for one or more hook bosses, i.e., tabs, that are located at the juncture between the neck and body and onto which a sizer is able to be locked. U.S. Patent Application Publication 2010/0270338, which is hereby incorporated by reference in its entirety for all purposes, teaches a hook boss, configured as a tab in the form of an integral protrusion that is disposed in a groove of the neck. The sizer includes one or more internal tabs that lock on to the hook boss and resists unintended removal and actively prevents malicious removal.

The securing feature of the hook boss on the neck and the tabs in the sizer is a strongly preferred feature of a GOH hanger, due to the time saving use of GOB hangers. After a garment is finished by a garment factory, the garment is placed on a GOB hanger while still in the garment factory. A sizer indicating the garment's size is then secured on the hanger. The securing feature in the GIH hangers advantageously prevents the unintended removal of the sizer due to jostling and handling during shipping, often halfway across the world.

Once the garment arrives in a store, store clerks need only hang the garment on display rack without having to place the garment on a hanger and fit the correct sizer. While on retail display, the securing feature prevents the unintended removal of the sizer due to handling by interested shoppers and the malicious removal of the sizer by uncooperative shoppers, thus, reducing time and costs in inventory management.

Upon sale of the garment, the GOB hanger and garment are separated. The hanger is then returned to a predetermined entity for reuse or material recycling. All the while the sizer preferably remains secured to the hanger via the hook boss. If the hanger is reused without the sizer, the sizer is forced from the hanger, typically causing breakage of the sizer.

Another type of hanger is a Swivel Hook hanger ("SH hanger"). An SH hanger is used by more upscale retailers, who typically receive garments that are not shipped on hangers. SH hangers have upscale feel and preferably have a more solid body. The retailers retain the SH hangers for reuse, often for many years.

Since hook bosses serve to prevent removal of the sizer, SH hangers do not have hook bosses. Consequently, sizers are rarely used on SH hangers. Retailers use other information to convey sizing information. One means is place the garment on an appropriate display using tags to indicate the beginning and/or end of a size's section.

To convey sizing information more easily for SH hangers and hangers that lack a hook boss, it is desirable to have a sizer that is interchangeable but has the advantageous securing feature used on GOH hangers to (a) prevent the unintended removal of the sizer due to handling by interested shoppers and (b) deter the malicious removal of the sizer by uncooperative shoppers.

SUMMARY OF THE INVENTION

These and other needs are met by the present invention. Therein, in accordance with one or more embodiments of the present invention a sizer for a hanger lacking a hook boss includes a pair of longitudinal walls spaced apart from each other by a pair of end sections, a first jaw disposed on one of the pair of end section. The pair of longitudinal walls flexes apart when the jaw passes over a flange of the hanger. The first jaw comprises a lower portion having a curved edge. The first jaw further comprises an upper portion. The lower portion and upper portion meet at an abrupt jaw point.

In accordance with one or more embodiments of the present invention, the first jaw comprises a lower portion and an upper portion, the lower portion having a thicker cross-sectional width than a cross-sectional width of the upper portion. The lower portion comprises a curved edge. One of the pair of end sections comprises a tab for spacing the sizer from the hanger. A second jaw is disposed opposite the first jaw on a same end section, the first and second jaw being spaced apart by a gap. Therein, the gap has a distance a dimension equal to or greater than a thickness of a web of the hanger.

In accordance with one or more embodiments of the present invention, each of the longitudinal walls lies in a respective plane, the planes intersecting each other.

In accordance with one or more embodiments of the present invention, a combination includes a sizer and a hanger lacking a hook boss. The hanger comprises an upper flange and web, and the sizer comprises a pair of longitudinal walls spaced apart from each other by a pair of end sections and a pair of jaws spaced apart by a gap. The gap has a dimension equal to or greater than a thickness of the web. When one of the jaws passes over the flange, at least one of the pair of longitudinal walls flexes apart relative to the other of the pair of longitudinal walls. At least one of the jaws comprises a lower portion having a curved edge. The at least one jaw further comprises an upper portion. The lower portion and upper portion meet at an abrupt jaw point.

In a further embodiment, at least one jaw comprises a lower portion and an upper portion, the lower portion having a thicker cross-sectional width than a cross-sectional width of the upper portion.

A method of use for a reusable sizer on at least one hanger lacking a hook boss is performed. Therein, the hanger comprises an upper flange and web and the sizer comprises a pair of longitudinal walls spaced apart from each other by a pair of end sections, and a pair of jaws spaced apart by a gap. The gap has a dimension equal to or greater than a thickness of the web.

In a mounting operation, when at least one jaw passes over the flange, at least one of the pair of longitudinal walls flexes apart relative to the other of the pair of longitudinal walls. When a jaw point of each jaw passes over the flange, the sizer becomes seated. In a dismounting operation, at least one jaw passes over the flange. When a jaw point of each jaw passes over the flange and the hook and neck have passed through the through-opening, the sizer has been removed.

In accordance with one or more embodiments of the present invention, the sizer may include a pair of protrusion, wherein a first is disposed on a first wall of the pair of longitudinal walls and directed toward a second wall of the pair of longitudinal walls.

Other embodiments and combinations of embodiments are intended and all embodiments may be used in combination with any one other or multiple other embodiments.

BRIEF DESCRIPTION OF THE DRAWINGS

FIG. 1*d* is a front view thereof, the rear view being substantially similar.

FIG. 1*e* is a right-hand side, i.e., end, view thereof, the left-hand side view thereof being substantially similar.

DETAILED DESCRIPTION OF THE INVENTION

Figure 1A:
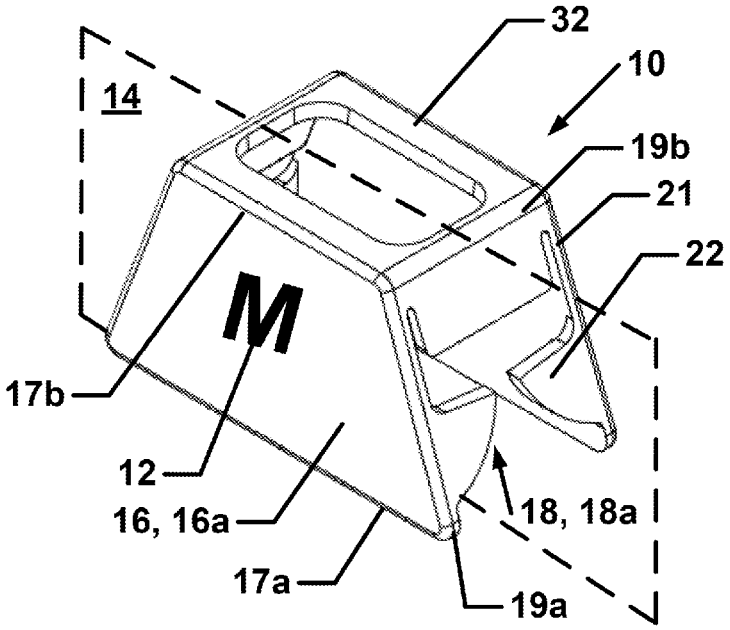
FIG. 1*a* is an isometric view of an improved sizer in accordance with one or more embodiments of the present invention.

Reference will now be made in detail to several views of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, left, right, up, down, over, above, below, beneath, rear, and front may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Figure 1B:
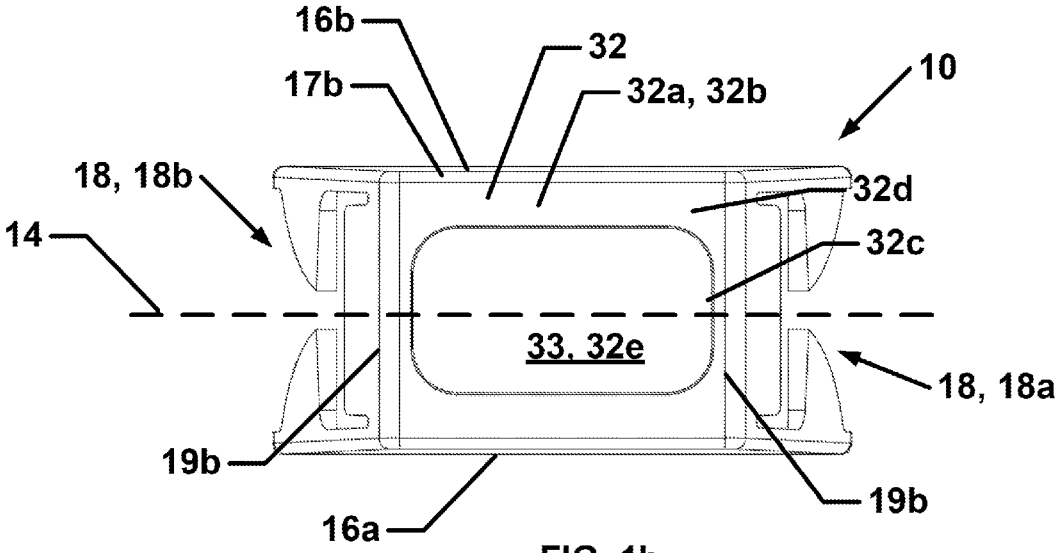
FIG. 1*b* is a top view thereof.
Figure 1C:
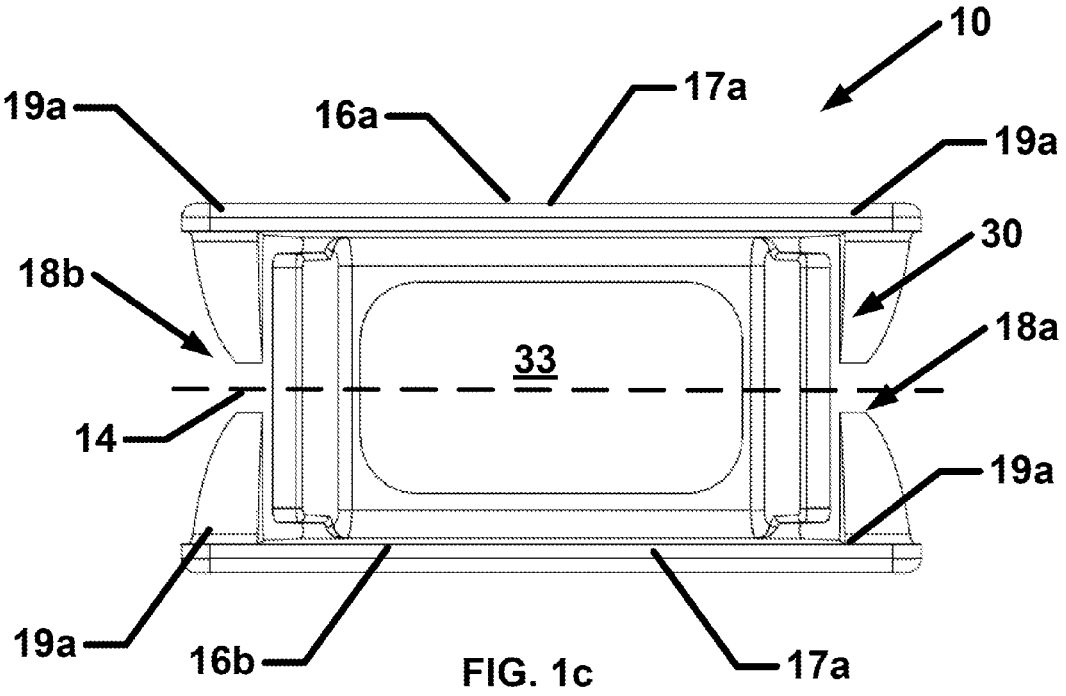
FIG. 1*c* is a bottom view thereof.
Figure 1D:
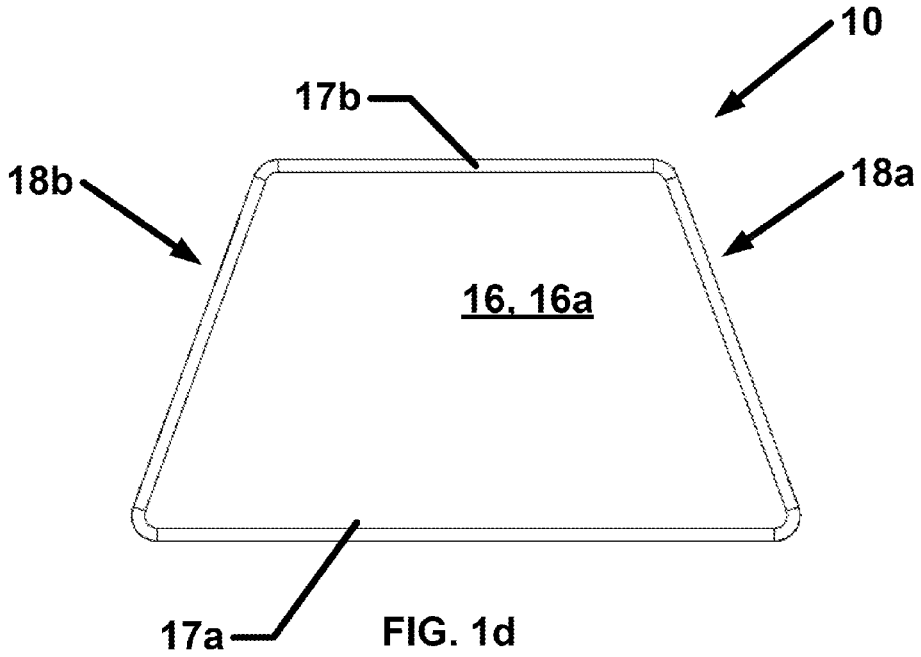
Figure 1E:
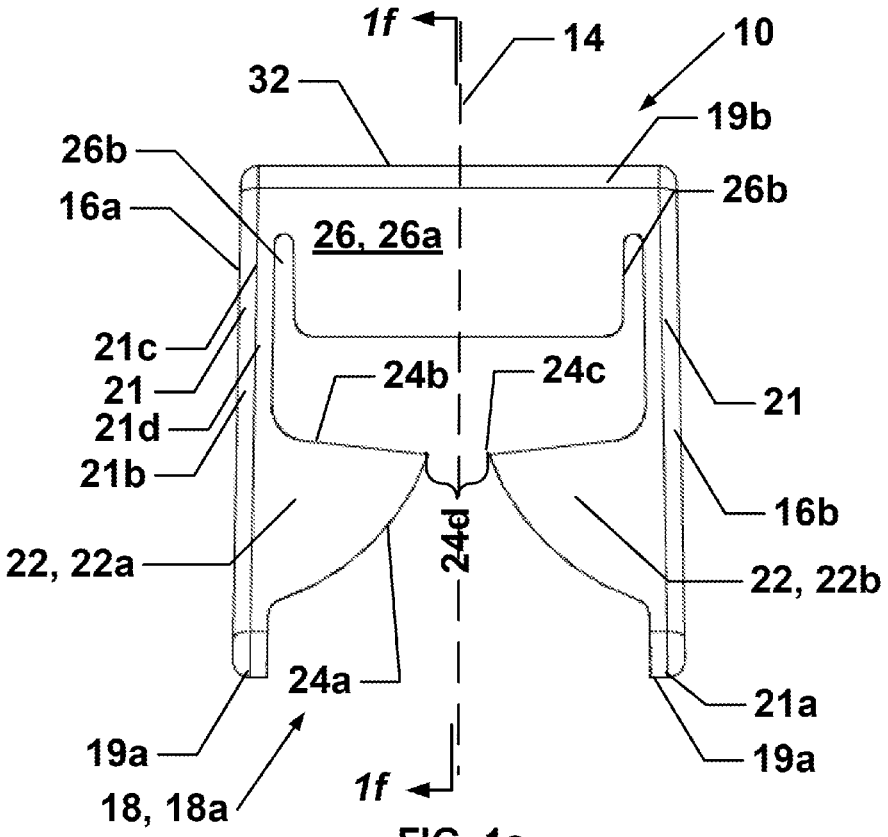
Figure 1F:
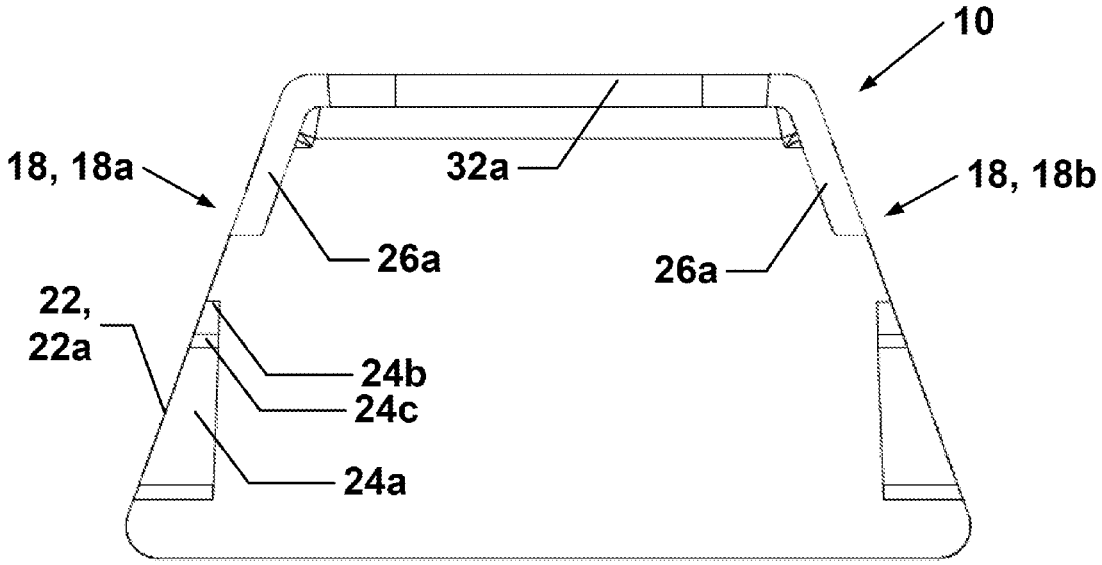
FIG. 1*f* is a longitudinal cross-section of the sizer of FIG. 1*a*.

FIG. 1*a* is an isometric view of an improved sizer in accordance with one or more embodiments of the present invention. FIG. 1*b* is a top view thereof; FIG. 1*c* is a bottom view thereof; FIG. 1*d* is a front view thereof, the rear view being substantially similar; and FIG. 1*e* is a right-hand side, i.e., end, view thereof, the left-hand side view thereof being substantially similar. FIG. 1*f* is a longitudinal cross-section of the sizer of FIG. 1*a*.

Figure 2:
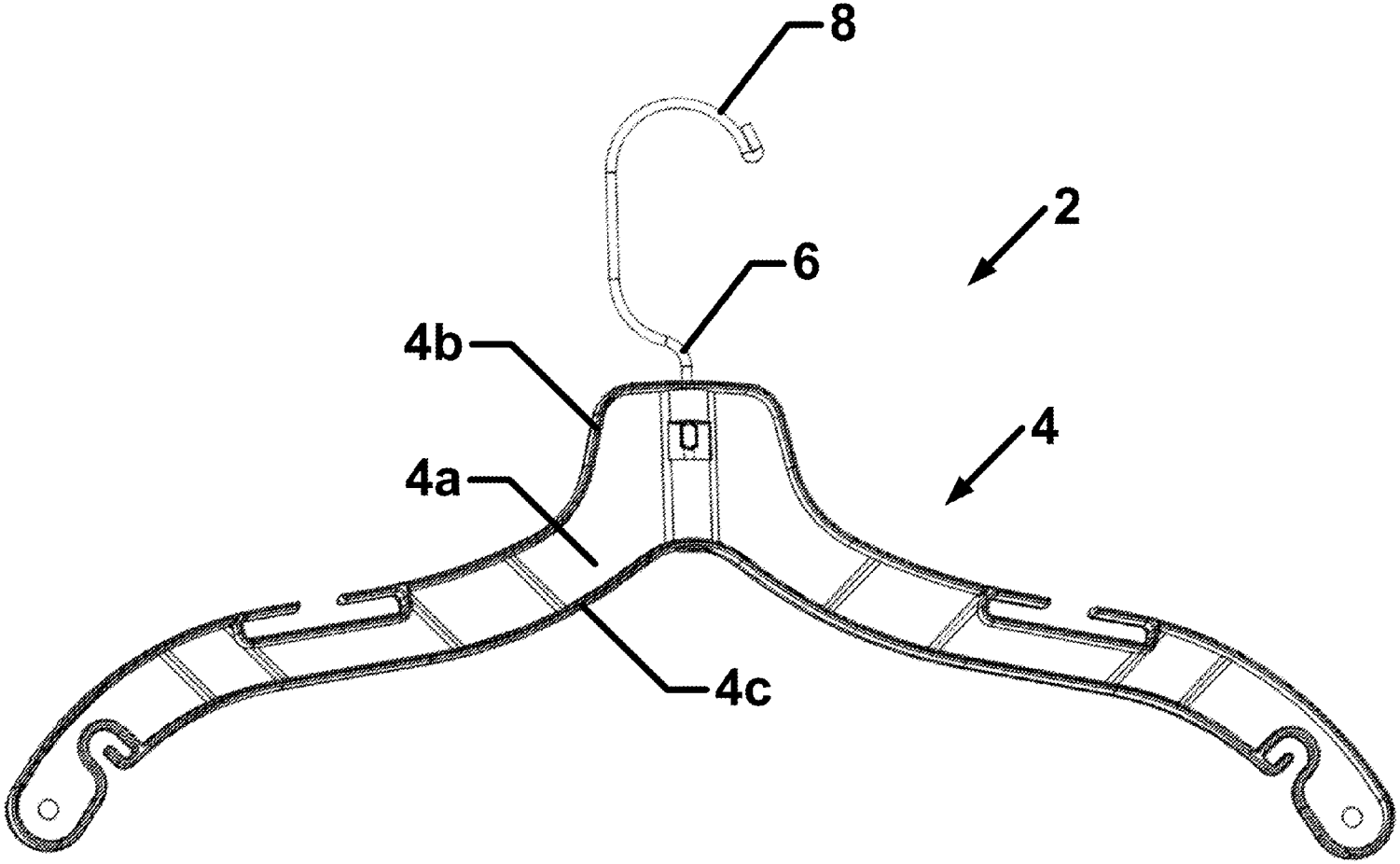
FIG. 2 is a front view of a hanger of the present invention.

FIG. 2 is a front view of a hanger of the present invention.

Figure 3B:
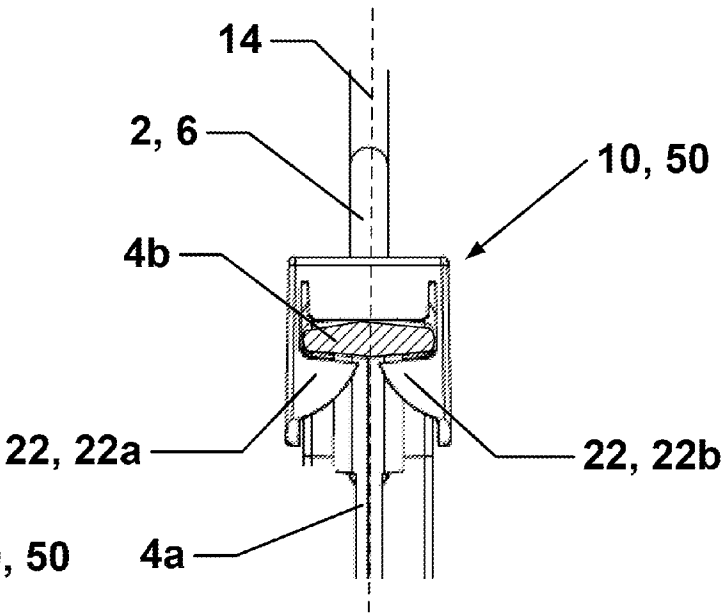
FIG. 3*b* is a cross-sectional view thereof.
Figure 3A:
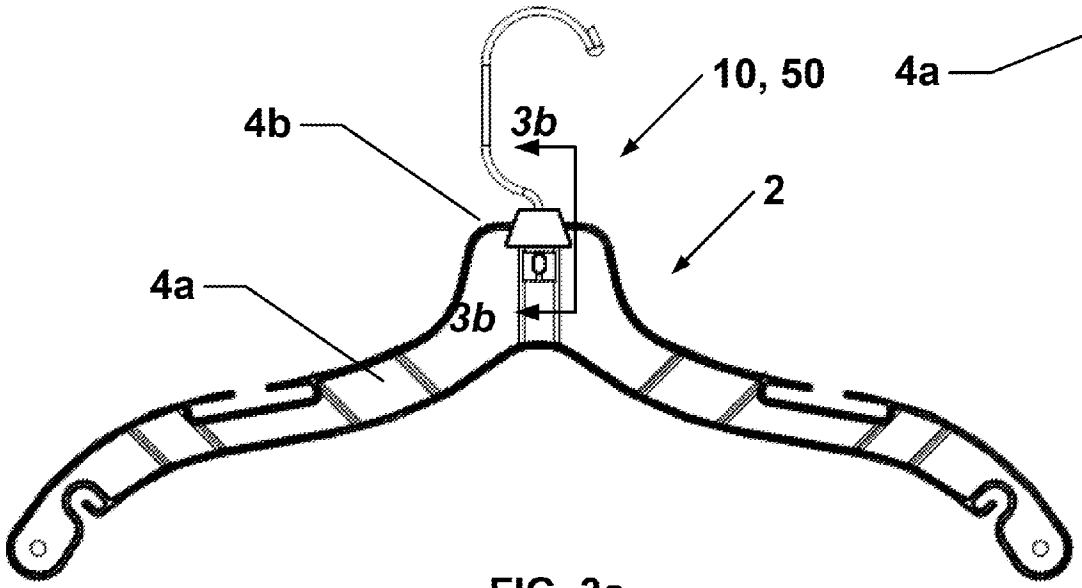
FIG. 3*a* is a front view of a sizer of FIGS. 1*a*-1*e* mounted on the hanger of FIG. 2 in accordance with one or more embodiments of the present invention.

FIG. 3*a* is a front view of a sizer of FIGS. 1*a*-1*e* mounted on the hanger of FIG. 2 in accordance with one or more embodiments of the present invention. FIG. 3*b* is a first cross-sectional view thereof.

Therein, an improved sizer 10 conveys information 12, such as a clothing size, to a consumer and is preferably used with a swivel-hook type hanger 2. Sizer 10 includes a securing feature comprising one or more jaws, as described below, that (a) prevents the unintended removal of the sizer due to handling by interested shoppers and (b) deters the malicious removal of the sizer by uncooperative shoppers.

Hanger 2 is a swivel-hook (SH) type hanger having a body 4, a neck 6, and a hook 8. Body 4 comprises a web 4*a*, upper flange 4*b*, and lower flange 4*c*, which with web 4*a* form an I shaped cross-sectional structure for improved rigidity.

Sizer 10 is preferably repeatedly re-used on the same hanger 2 or one or more other hangers 2. The reuse requires sizer 10 to be mounted and dismounted from hanger 2 and causes sizer 10 to be flexed, as explained herein.

In order to achieve economies of scale, sizer 10 is most preferably has a unitary structure, which is preferably made by injection molding using polystyrene plastic or other molding material such styrene butadiene styrene (SBS).

Sizer 10 comprises a general polyhedral shape, especially a substantially prismatic shape, having a pair of longitudinal walls 16, a pair of end sections 18 having one or more jaws 22, an open base 30, and a top 32. Sizer 10 comprises a longitudinal plane 14, which, when sizer 10 is mounted on hanger 2, is preferably coincident to a longitudinal axis of hanger body 4.

Each wall of a pair of longitudinal walls 16*a*, 16*b* comprises a plane, which is substantially parallel to the plane formed by the other wall. The lower most and upper most edges of walls 16*a*, 16*b* are defined, respectively, by a bottom edge 17*a* and a top edge 17*b*, which are substantially parallel to each other.

Information 12 may be printed, etched, laser engraved, or otherwise disposed on one or both walls 16*a*, 16*b* in order to convey information, such as sizing, to the consumer. Longitudinal sides 16*a*, 16*b*, may have one or more cut-out, openings, or other means to add decorations and/or convey information to a user. Thus, for example, sizing information may be conveyed by removing a portion of one or more walls 16*a*, 16*b*.

A pair of end sections 18*a*, 18*b*, respectively, connects sides 16*a* and 16*b* together and each end section is preferably substantially open. Each section 18*a*, 18*b* is disposed in a plane that is oriented transverse to longitudinal plane 14. The planes are angled with respect to each other so that they intersect each other. The lower most and upper most edges of each section 18*a*, 18*b* are defined, respectively, by one or more bottom edge portions 19*a* and a top edge 19*b*, which is substantially parallel to one or more bottom edge portions 19*a*.

One or, preferably, both end sections 18*a*, 18*b* comprise one or more side edges 21 and one or more jaws 22, preferably provided in pairs 22*a*, 22*b* and are spaced from a respective terminal end 21*a* of the respective end section 18*a*, 18*b*. Each pair of jaws 22*a*, 22*b* comprise a lower portion 24*a* that is preferably curved but may be straight and a top portion 24*b* that may be straight or have a curve edge. Portions 24*a* and 24*b* meet at a jaw point 24*c* that is abrupt in order to catch the jaw under upper flange 4*b* and (a) prevents the unintended removal of the sizer due to handling by interested shoppers and (b) deters the malicious removal of the sizer by uncooperative shoppers.

One or more jaws 22*a*, 22*b* comprise a greater thickness at lower portion 24*a* than at top portion 24*b* in order to permit passing of the sizer over flange 4*b*. Jaw portion 24*b* is joined to edge 21.

Therein, in accordance with one or more embodiments of the present invention, the securing feature comprises at least a jaw point and the greater thickness at lower portion 24*a* than at top portion 24*b* of a jaw, the securing feature (a) preventing the unintended removal of the sizer due to handling by interested shoppers and (b) deterring the malicious removal of the sizer by uncooperative shoppers. Advantageously, the securing feature does not interfere with the intended removal as discussed below.

In accordance with at least another embodiment of the present invention, the securing feature consists of two jaw points on each end section and the greater thickness at lower portion 24*a* than at top portion 24*b* of the jaws, the securing feature (a) preventing the unintended removal of the sizer due to handling by interested shoppers and (b) deterring the malicious removal of the sizer by uncooperative shoppers. Advantageously, the securing feature does not interfere with the intended removal as discussed below.

When the jaws are provided in pairs 22*a* and 22*b*, respective jaw points 24*c* are spaced from each other by a gap 24*d*. Gap 24*d* preferably has a dimension that is slightly larger than web 4*a* of hanger 2, as shown in FIGS. 2*b* and 2*c*. The gap dimension typically is 1-4 mm.

A tab 26 is disposed spaced apart from one or more jaws 22*a*, 22*b*. Tab 26 comprises a main portion 26*a* and one or more indents 26*b* that space main portion 26*a* from edge 21. Edge 21 comprises a narrow portion 21*b* that transitions to a wider portion 21*c* at a point 21*d*. Point 21*d* is approximate to a beginning of respective indent 26*b*. Therein, preferably wider portion 21*b* resists edge breakout as tab 26 becomes flexed when sizer 10 is mounted on a hanger such as hanger 2.

Each end section 18*a*, 18*b* comprises a margin 28 that comprises a distal end of indents 26*b* and to which tab 26 is joined. Margin 28 includes edge 19*b*, which preferably provides reinforcement for sections 18*a*, 18*b*. During mounting and dismounting of the sizer from the hanger body, the one or more jaws pass over upper flange 4*b*, as shown in FIG. 2*d*, causing one or more end sections and/or one or more longitudinal walls to flex apart relative to other section and/or wall.

A base 30 is defined by pairs of edges 17*a* and 19*a* forming a plane; a top 32 is defined by edges 17*b* and 19*b* forming a plane. Therein, the planes of base 30 and top 32 are substantially parallel to each other. Top 32 comprises a peripheral margin 32*a* having one or more longitudinal segments 32*b*, transverse segments 32*c*, and curved segments 32*d* that define an opening 32*e*. Opening 32*e* defines a first end of a through-opening 33 while base 30 defines the second end of the through-opening.

In use, mounting of sizer 10 occurs by passing an initial portion of hook 8 through-opening 33. The sizer is then advanced along the hook to neck 6. To secure the sizer, a downward, mounting force is applied to top 32 directing the sizer closer to hanger body 4. The force causes the one or more jaws, preferably due to the curved edge on each jaw and the pre-existing gap, to flex apart and in turn causes the one or more longitudinal walls 16*a*, 16*b* and/or one or more end sections 18*a*, 18*b* to flex apart relative to each other. This creates sufficient space for the one or more jaws to pass over upper flange 4*b*. Once the one or more jaws pass the upper flange, the jaws return to the initial position and the sizer is properly seated.

Dismounting of sizer 10 occurs when an upward, removal force is applied directing the sizer away from the hanger body and closer to the hook. Therein, the removal force causes the one or more jaws to flex apart and in turn causes the one or more longitudinal walls 16*a*, 16*b* and/or one or more end sections 18*a*, 18*b* to flex apart relative to each other. Once the one or more jaws passes the upper flange, the jaws return to the initial position. The sizer can then be removed by passing the sizer over the neck and hook. The sizer can then be reused on the same hanger 2 or another hanger 2. Therein, the securing feature does not interfere with the intended removal and/or the reuse of the sizer.

Figure 4A:
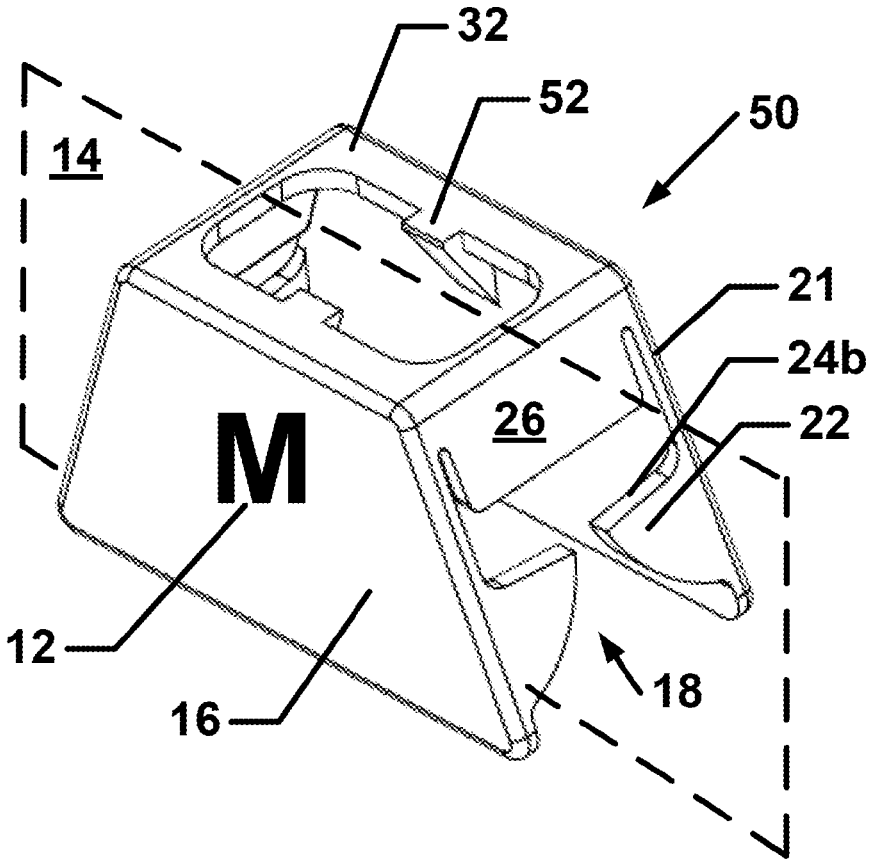
FIG. 4*a* is a perspective view of a sizer in accordance with one or more embodiments of the present invention.
Figure 4B:
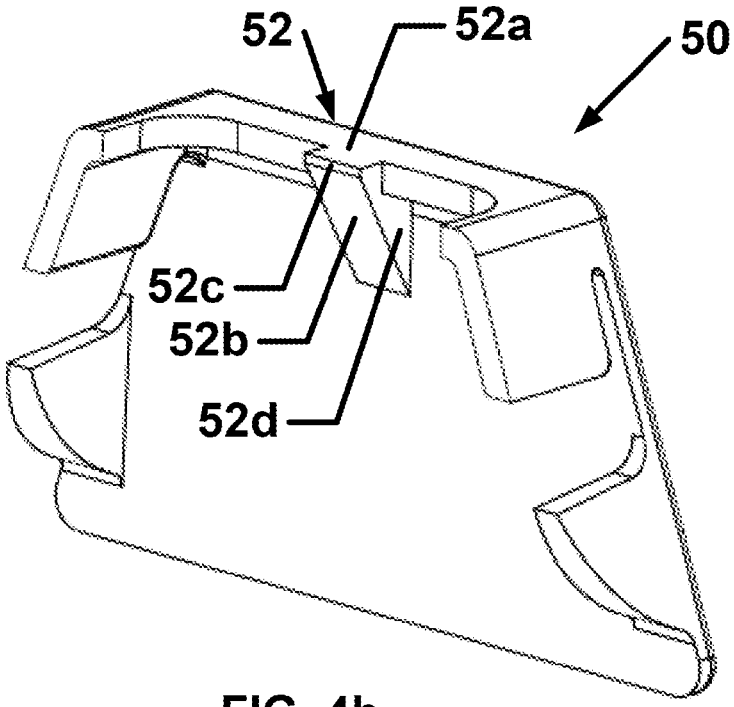
FIG. 4*b* is a cross-sectional view of the sizer of FIG. 4*a*.

FIG. 4*a* is a perspective view of a sizer in accordance with one or more embodiments of the present invention. FIG. 4*b* is a cross-sectional view of the sizer of FIG. 4*a*.

Figure 5A:
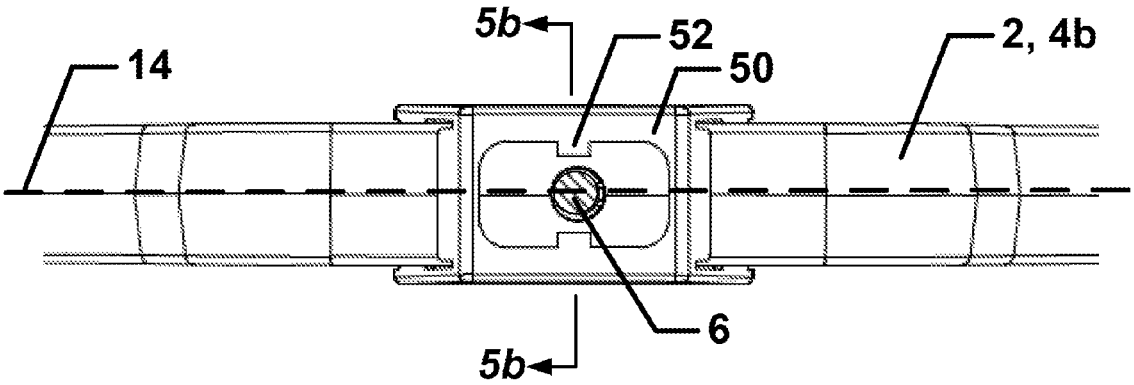
FIG. 5*a* is a top view of the sizer of FIGS. 4*a* and 4*b* mounted on the hanger of FIG. 2 in accordance with one or more embodiments of the present invention.
Figure 5B:
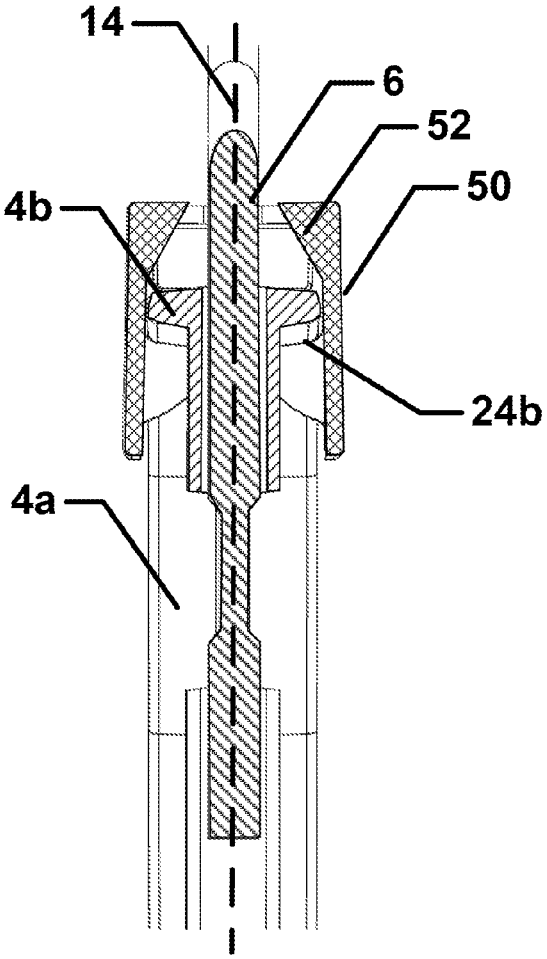
FIG. 5*b* is a cross-sectional view thereof.

FIG. 5*a* is a top view of the sizer of FIGS. 4*a* and 4*b* mounted on the hanger of FIG. 2 in accordance with one or more embodiments of the present invention. FIG. 5*b* is a cross-sectional view thereof.

In accordance with one or more embodiments of the present invention, a sizer 50 may be constructed substantially similar to sizer 10, including all features described with respect to sizer 10, and functions substantially similar. However, sizer 50 includes one or more protrusions 52 that help in locating sizer 50 over top flange 4*b* of hanger 2. That is, protrusions 52 locate top portion 24*b* of respective jaws 22*a*, 22*b* adjacent to an underside of flange 4*b*.

Each protrusion 52 may be formed substantially as a wedge shape and comprises a top surface 52*a* that is preferably coplanar with top 32 directed toward the interior of sizer 5, i.e., when mounted on hanger 52 towards flange 4*b*. An inclined surface 52*b* meets a longitudinal side 16.

Surfaces 52*a* and 52*b* may be joined by a chamfered edge 52*c* to prevent unintended breakage of protrusion 52. Sides 52*d* are preferably perpendicular to surface 52*b* and/or surface 52*a*.

While the invention has been described in conjunction with specific embodiments, it is to be understood that many alternatives, modifications, and variations will be apparent to those skilled in the art in light of the foregoing description.

What is claimed is:

1. A sizer for a hanger lacking a hook boss, the sizer comprising:

an open base and an open top;

a pair of longitudinal walls spaced apart from each other, each wall of the pair of longitudinal walls intersecting a plane of the open base;

a pair of end sections, the pair of end sections being transverse to the pair of longitudinal walls and transverse to the plane of the open base, each pair of end sections connecting a first wall of the pair of longitudinal walls to a second wall of the pair of longitudinal walls; and a first jaw disposed in one of the pair of end section, the jaw comprising a lower portion having a curved edge, the first jaw being transverse to at least one of the longitudinal walls;

wherein the pair of longitudinal walls flex apart when the jaw passes over a flange of the hanger;

wherein the first jaw further comprises an upper portion; and wherein the lower portion has a thicker cross-sectional width than a cross-sectional width of the upper portion.

2. The sizer of claim 1, further comprising a pair of protrusions, each protrusion disposed on the first wall of the pair of longitudinal walls and directed toward the second wall of the pair of longitudinal walls.

3. The sizer of claim 1, wherein the lower portion and upper portion meet at an abrupt jaw point.

4. The sizer of claim 1, wherein one of the pair of end sections comprises a tab for spacing the sizer from the hanger.

5. The sizer of claim 1, further comprising a second jaw disposed opposite the first jaw on a same end section, the first and second jaw being spaced apart by a gap.

6. The sizer of claim 5, wherein the gap has a distance a dimension equal to or greater than a thickness of a web of the hanger.

7. The sizer of claim 1, wherein each of the end sections lies in a respective plane, the planes intersecting each other.

8. The sizer of claim 1, wherein each of the longitudinal walls lies in a respective plane, the planes being substantially parallel to each other.

9. A sizer for a hanger lacking a hook boss, the sizer comprising:

an open base and an open top;

a pair of longitudinal walls spaced apart from each other, each wall of the pair of longitudinal walls intersecting a plane of the open base;

a pair of end sections, the pair of end sections being transverse to the pair of longitudinal walls and transverse to the plane of the open base, each pair of end sections connecting a first wall of the pair of longitudinal walls to a second wall of the pair of longitudinal walls; and a first jaw disposed in one of the pair of end section, the jaw comprising a lower portion having a curved edge, the first jaw being transverse to at least one of the longitudinal walls;

wherein the pair of longitudinal walls flex apart when the jaw passes over a flange of the hanger; hanger, wherein the first jaw further comprises an upper portion; and wherein the upper portion comprises a second curved edge.

10. A sizer for a hanger lacking a hook boss, the sizer comprising:

a pair of longitudinal walls spaced apart by an open top, each longitudinal wall having a top edge adjacent to the top and a pair of side edges intersecting the top edge;

a pair of jaws spaced apart by a gap, each jaw being transverse to one longitudinal wall and being transverse to the top, each jaw disposed in one of the side edges;

wherein the pair of longitudinal walls flex apart when the jaw passes over a flange of the hanger;

wherein at least one jaw comprises a lower portion having a curved edge;

wherein the first jaw further comprises an upper portion; and wherein the lower portion has a thicker cross-sectional width than a cross-sectional width of the upper portion.

11. A sizer for a hanger lacking a hook boss, the sizer comprising:

a pair of longitudinal walls spaced apart by an open top, each longitudinal wall having a top edge adjacent to the top and a pair of side edges intersecting the top edge;

a pair of jaws spaced apart by a gap, each jaw being transverse to one longitudinal wall and being transverse to the top, each jaw disposed in one of the side edges;

wherein the pair of longitudinal walls flex apart when the jaw passes over a flange of the hanger;

wherein at least one jaw comprises a lower portion having a curved edge;

wherein the first jaw further comprises an upper portion; and wherein the upper portion comprises a second curved edge.

12. A method of use for a reusable sizer on at least one hanger lacking a hook boss, the hanger comprising an upper flange and web, the sizer comprising a pair of longitudinal walls spaced apart from each other by a top, a pair of end sections connecting a first wall of the pair of longitudinal walls to a second wall of the pair of longitudinal walls, at least one end section transverse to one of the longitudinal walls and transverse to the top; and a pair of jaws spaced apart by a gap, one of the pair of jaws disposed in the at least one end section, the gap having a dimension equal to or greater than a thickness of the web;

the method comprising the step of:

in a mounting operation, passing at least one jaw over the flange, at least one of the pair of longitudinal walls flexes apart relative to the other of the pair of longitudinal walls;

a dismounting operation, passing the at least one over the flange;

wherein the hanger further comprising a hook and a neck, the sizer further comprising a through-opening, wherein when a jaw point of each jaw passes over the flange and the hook and neck have passed through the through-opening, the sizer has been removed.

13. The method of claim 12, wherein when a jaw point of each jaw passes over the flange, the sizer becomes seated.

* * * * *